US011441355B2

(12) United States Patent
Lawson

(10) Patent No.: US 11,441,355 B2
(45) Date of Patent: Sep. 13, 2022

(54) LADDER STABILIZATION AND LIGHTING SYSTEM

(71) Applicant: Steven Lawson, Surprise, AZ (US)

(72) Inventor: Steven Lawson, Surprise, AZ (US)

( * ) Notice: Subject to any disclaimer, the term of this patent is extended or adjusted under 35 U.S.C. 154(b) by 0 days.

(21) Appl. No.: 16/931,317

(22) Filed: Jul. 16, 2020

(65) Prior Publication Data

US 2021/0062582 A1 Mar. 4, 2021

Related U.S. Application Data

(60) Provisional application No. 62/895,851, filed on Sep. 4, 2019.

(51) Int. Cl.

| | |
|---|---|
| ***E06C 7/46*** | (2006.01) |
| ***F21V 33/00*** | (2006.01) |
| *F21Y 115/10* | (2016.01) |

(52) U.S. Cl.
CPC ..... *E06C 7/46* (2013.01); *F21V 33/0004* (2013.01); *F21Y 2115/10* (2016.08)

(58) Field of Classification Search
CPC ..... E06C 7/45; F21V 33/0004; F21Y 2115/10
See application file for complete search history.

(56) References Cited

U.S. PATENT DOCUMENTS

| | | | | |
|---|---|---|---|---|
| 10,081,981 | B2 * | 9/2018 | Finegan | E06C 7/083 |
| 2009/0200110 | A1 * | 8/2009 | Esselborn | E06C 7/46 182/107 |
| 2013/0021787 | A1 * | 1/2013 | Noble | F21V 23/0492 362/156 |
| 2017/0350584 | A1 * | 12/2017 | Hulet | E06C 7/00 |

* cited by examiner

*Primary Examiner* — Anabel Ton
(74) *Attorney, Agent, or Firm* — Keith Miller Patent Law; Keith Miller

(57) ABSTRACT

A ladder stabilization and lighting system comprising a ladder stabilizing boot, comprising a base pad and a plurality of vertical walls extending upwardly from the base pad, where the plurality of vertical walls extending upward from the base pad form a rectangular recess configured to provide a friction fit on a ladder rail end, and where the base pad is configured to be a flat planar surface larger in area than the ladder rail end. The ladder stabilizing boot further comprises a light positioned on at least one outer surface of the plurality of vertical walls, where the light is powered by a power source in electrical connection with the light and a switch.

13 Claims, 6 Drawing Sheets

LADDER STABILIZATION AND LIGHTING SYSTEM

CROSS-REFERENCE TO RELATED APPLICATION

The present application is related to and claims the benefit under 35 U.S.C. § 119(e) of the prior U.S. provisional application Ser. No. 62/895,851 filed Sep. 4, 2019 entitled "Ladder Stabilization and Lighting System", the contents of which are incorporated herein by this reference in their entirety, and are not admitted to be prior art with respect to the present invention by the mention in this cross-reference section.

FIELD OF THE INVENTION

The present invention relates to the field of ladders. In particular, the present invention relates to a ladder stabilization and lighting system configured to increase the footprint of a ladder while providing a light to illuminate the area around the base of the ladder.

BACKGROUND OF THE INVENTION

The use of ladder stabilizing devices, or ladder boots or shoes, is known in the prior art. These ladder stabilizing devices are typically configured for the purpose of preventing tipping of a ladder, preventing slipping of the ladder during use on unstable, soft, or uneven ground. Also, ladder stabilizers are designed to prevent the ladder from sinking into a soft surface by providing a larger surface area for the ladder to sit on.

However, none of the existing ladder stabilizing devices are designed to provide light around the base of the ladder they are attached to. It's pretty normal for people to use a ladder near the end of the day, or in a darkened room to change a light bulb, where the area around the base of the ladder becomes difficult to see due to the failing ambient light. When stepping off the ladder in the darkened condition it's difficult to identify where the last rung of the ladder is, therefore missing where the ground surface is. Or, when stepping off the ladder the user can't see the condition of the ground surface.

Thus, there exists a need for a ladder stabilization and lighting system designed to be left on a step ladder which can be used in both indoor and outdoor environments and provide a light configured such that a user of the ladder can see where the bottom rungs of the ladder are and where the ground surface area is in relation to the ladder. The present invention described below solves these problems.

Any discussion of prior art throughout the specification should in no way be considered as an admission that such prior art is widely known or forms part of the common general knowledge in the field.

BRIEF SUMMARY OF THE INVENTION

According to an object of the present invention there is provided a ladder stabilization and lighting system comprising a ladder stabilizing boot comprising a base pad and a plurality of vertical walls extending upwardly from the base pad, and a light.

Another object of the present invention is provided the plurality of vertical walls form a rectangular recess configured to provide a friction fit on a ladder rail end and wherein the base pad is configured to be a flat planar surface larger in area than the ladder rail end.

Another object of the present invention is provided the plurality of vertical walls are configured to be angled such that when the step ladder is folded closed the vertical walls fit flush against the opposite ladder rail.

Another object of the present invention is provided a light disposed on an outer surface of the plurality of vertical walls electrically coupled with a power source.

Another object of the present invention is provided a switch located near the power source, wherein the switch is configured to apply power to the light such that a user can see the bottom portion of the ladder in addition to the ground surface the ladder is situated on.

Another object of the present invention is provided the switch may be a push button situated for a user to activate with their foot.

BRIEF DESCRIPTION OF THE DRAWINGS

The preferred embodiment of the present invention will now be described, by way of example only, with reference to the accompanying drawings in which.

DETAILED DESCRIPTION OF THE INVENTION

The foregoing and other objectives, features, and advantages of the invention will be more readily understood upon consideration of the following description of the invention taken in conjunction with the accompanying drawings.

Figure 1:
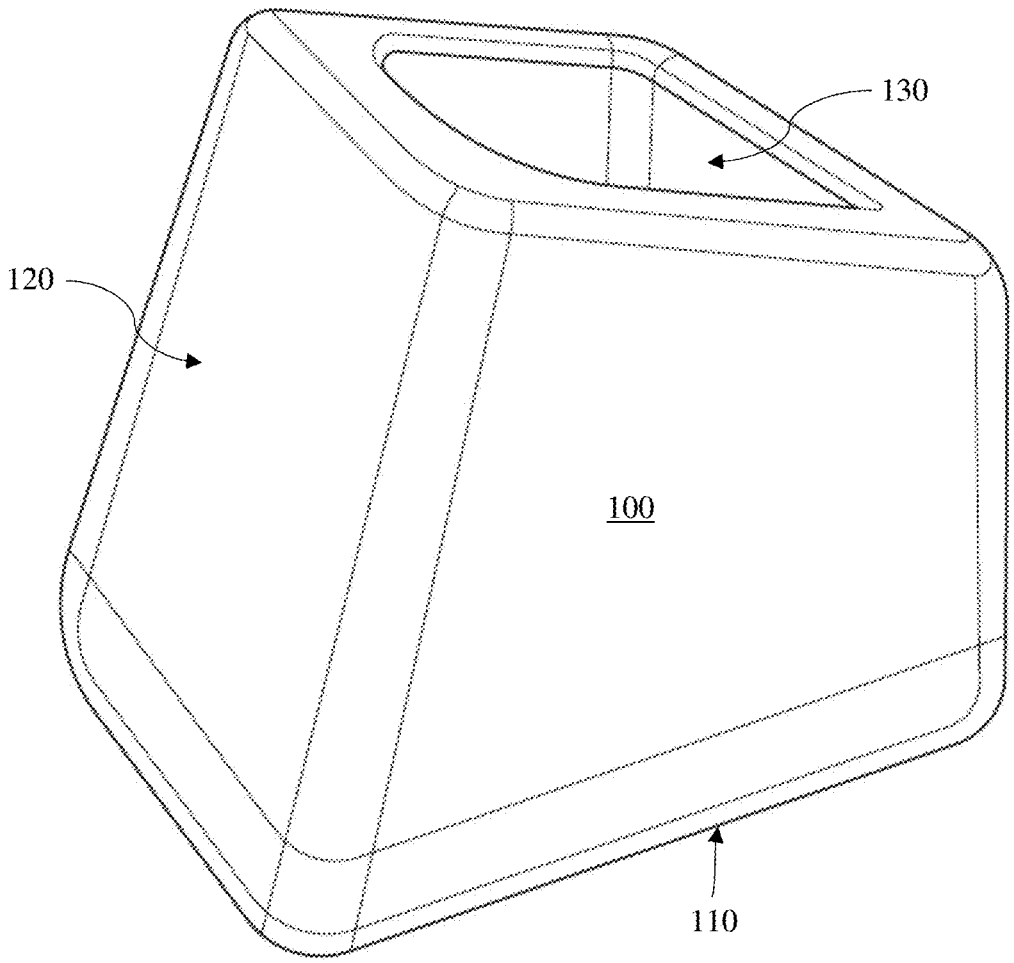
FIG. 1 shows a perspective view of a ladder foot stabilization and lighting system according to the invention.

Now referring to the drawings, FIG. 1 shows the present invention is preferably a ladder stabilization and lighting system comprising a ladder stabilizing boot 100, comprising a base pad 110 and a plurality of vertical walls 120 extending upwardly from the base pad 110, wherein the plurality of vertical walls 120 form a rectangular recess 130 configured to provide a friction fit on a ladder rail end, and wherein the base pad 110 is configured to be a flat planar surface larger in area than the ladder rail end.

For purposes of this patent application, the following ladder structures will be used. A ladder is typically made up of two parallel ladder rails which are connected together via a plurality of ladder rungs. A ladder rail end is defined as the part of the ladder rail in contact with a ground surface. Although the present invention is designed for use on a foldable step-ladder, it is possible for them to be functional on a variety of ladder types.

Figure 2:
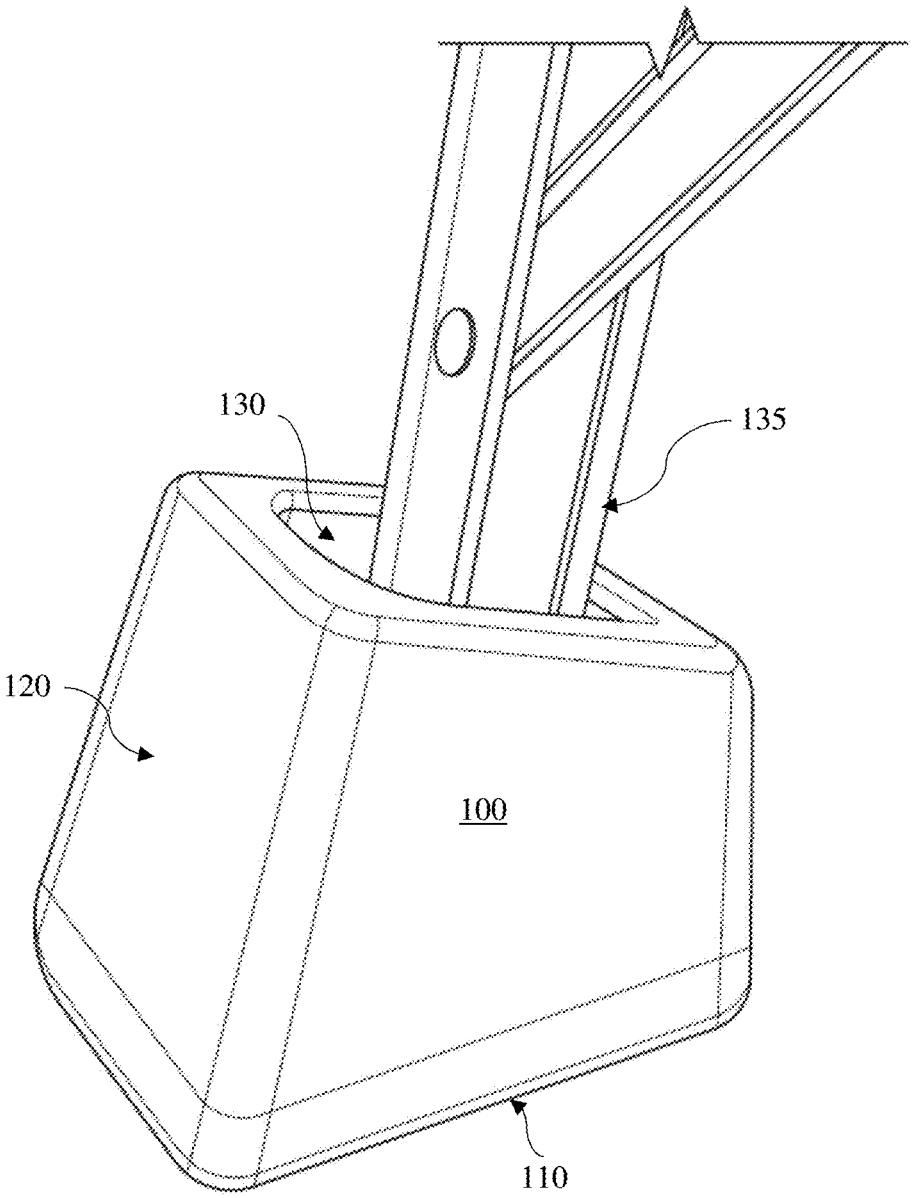
FIG. 2 shows a perspective view of a ladder foot stabilization and lighting system mounted on a ladder rail according to the invention.

As shown in FIG. 2, the ladder stabilizing boot 100 rectangular recess 130 is configured to provide a friction fit onto the ladder rail end 135 such that the ladder stabilizing boot 100 stays attached to the ladder rail end 135 when not in contact with a ground surface. The plurality of vertical walls 120 are configured to be angled such that when the step ladder is folded closed at least one of the plurality of vertical walls 120 of the ladder stabilizing boot 100 fit flush against the opposite ladder rail. Alternately preferably, there may be a flexible material inside the rectangular recess, such as foam material, for the ladder rail end to fit in.

In one embodiment, the ladder stabilizing boot 100 is made of a rubber compound where the plurality of vertical walls 120 are integral to the base pad forming the ladder stabilizing boot. In an alternate embodiment, the base pad 110 and the plurality of vertical walls 120 are comprised of different materials where the plurality of vertical walls are coupled to the base pad. However, the base pad 110 and plurality of vertical walls 120 may be comprised of materials not enumerated herein such that the plurality of vertical walls are configured to allow for a friction fit onto the ladder rail end.

In one embodiment, the stabilizing boot 100 comprises a textured pattern on a bottom surface of the base pad 110, wherein the textured pattern is configured to provide non-slip contact with a ground surface. The textured pattern is embossed or engraved into the bottom surface of the base pad such that the textured pattern is in contact with the ground surface when in use. Alternately, the textured surface is comprised of a raised pattern, such as a diamond shaped pattern.

In one embodiment, the plurality of vertical walls 120 are integral to the base pad 110 such that the ladder stabilizing boot 100 is comprised of one piece.

Figure 3:
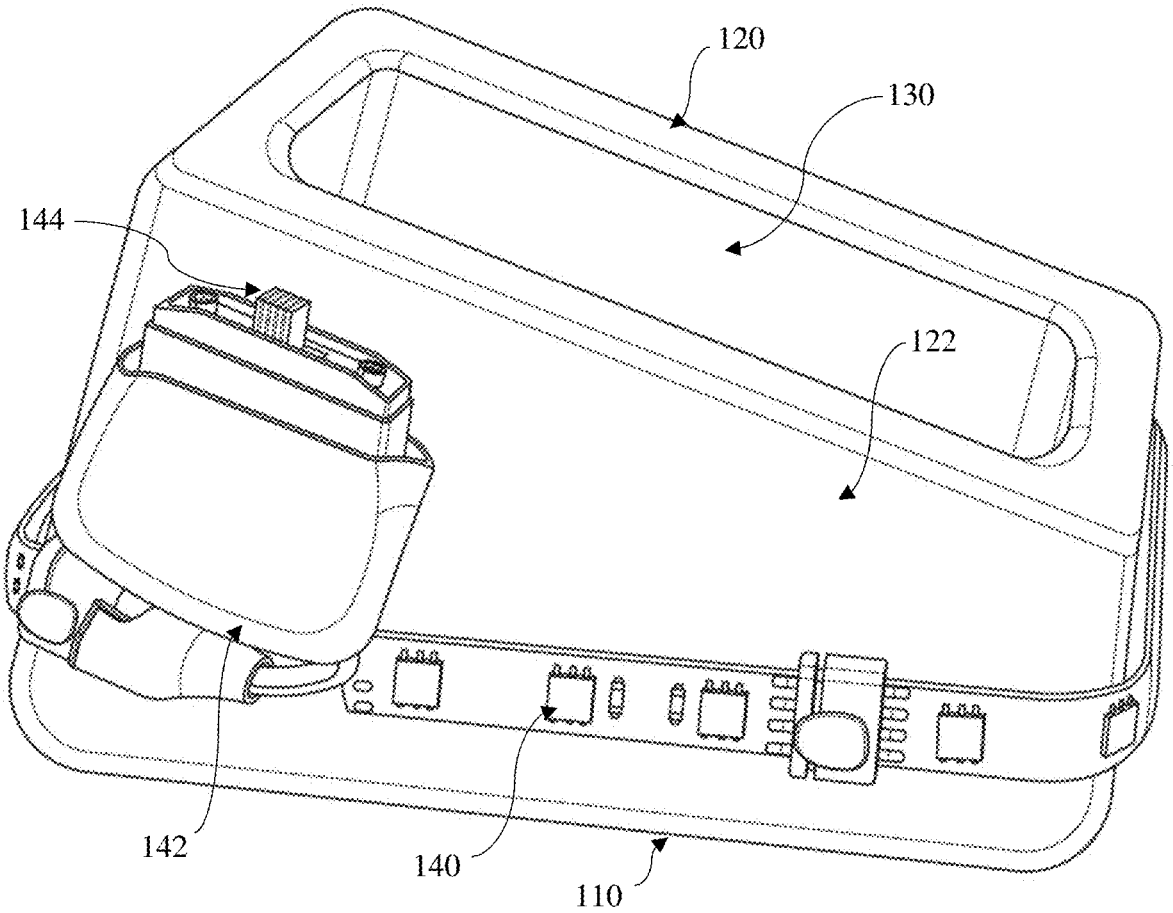
FIG. 3 shows a perspective view of a ladder foot stabilization and lighting system according to the invention.
Figure 4:
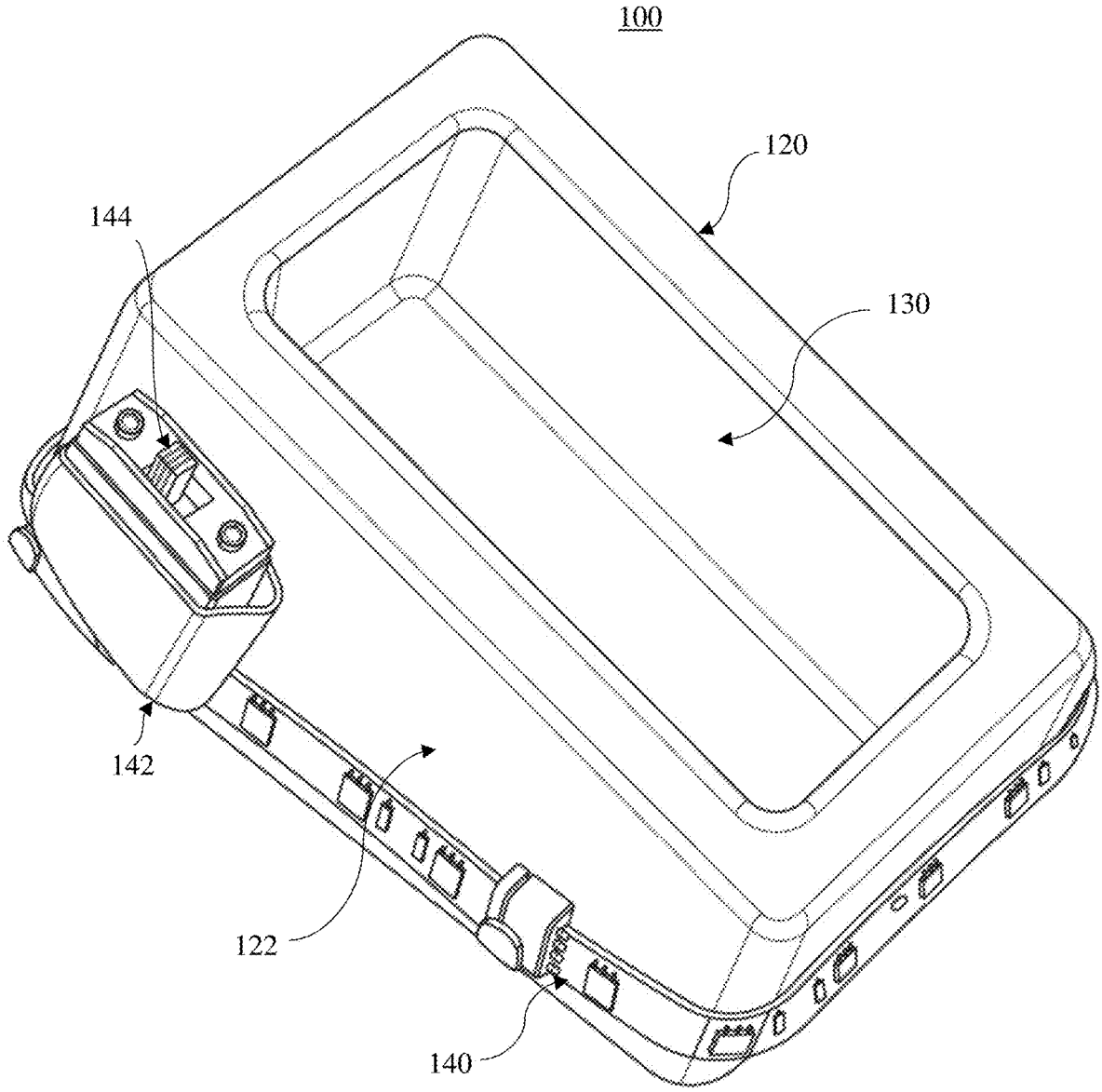
FIG. 4 shows a perspective view of a ladder foot stabilization and lighting system according to the invention.
Figure 5:
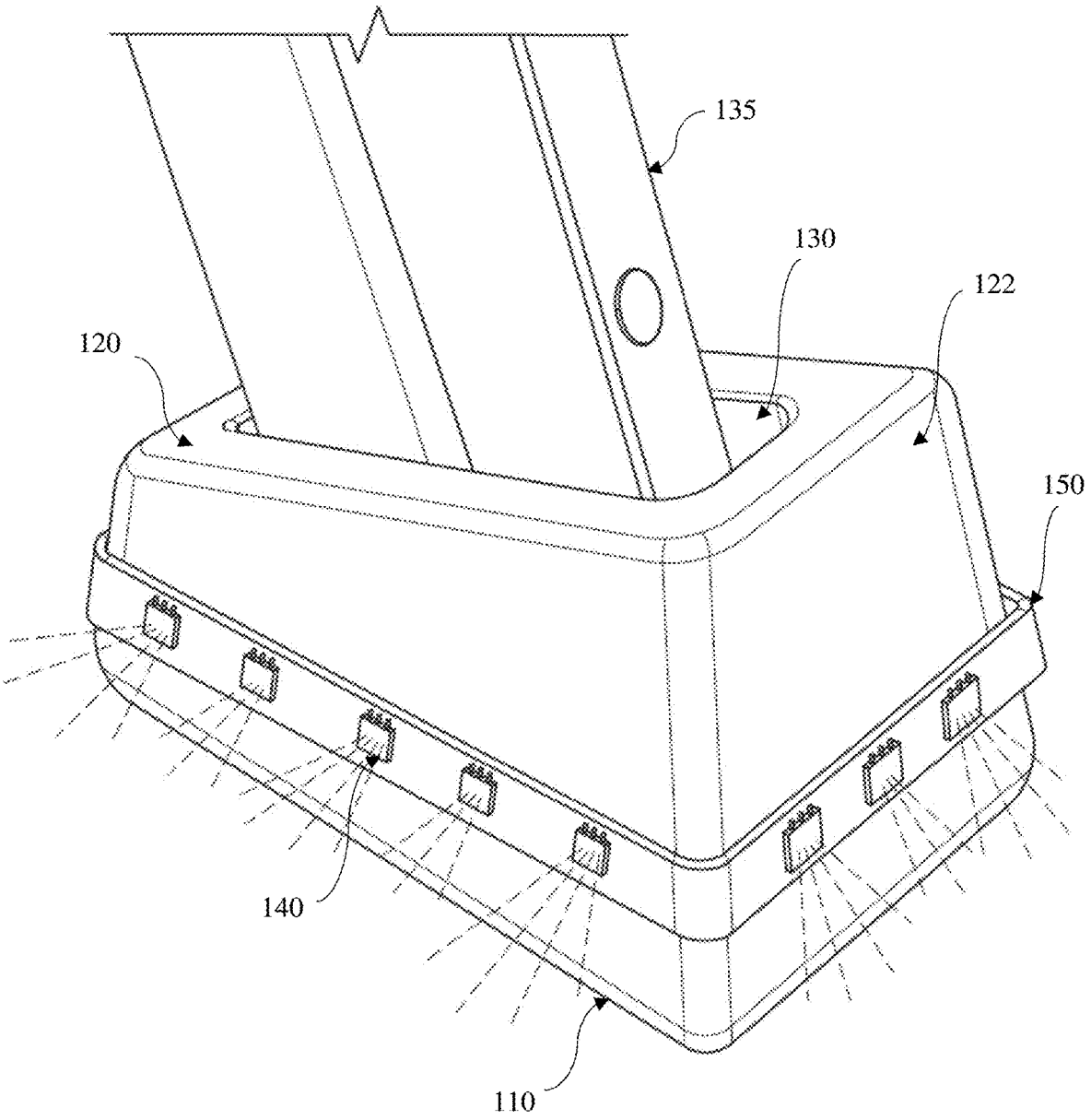
FIG. 5 shows a perspective view of a ladder foot stabilization and lighting system in operation according to the invention.

As shown in FIG. 3, a light 140 is disposed on at least one outside surface of the plurality of vertical walls 120. In this embodiment, the light 140 is located and configured to provide illumination to a ground surface area around the area the ladder is placed on. The light is preferably an LED light. However, any type of small light is contemplated and can be used.

As further shown in FIGS. 3-6, the light 140 is a flexible LED strip light 150. The flexible LED strip light 150 is comprised of a plurality of LED lights 140 in electrical connection along a flexible strip of material. In this embodiment, the flexible LED light strip 150 wraps around the plurality of vertical walls 120 to provide illumination all around the base of the ladder.

In one embodiment, the light 140 is disposed on an outer surface 122 of the plurality of vertical walls 120. The light may be disposed on any of the outer surfaces of the stabilizing boot. In one embodiment, the light is integrated onto the outer surface. In other embodiments, the light is attached to the outer surface of the plurality of vertical walls.

As further shown in FIGS. 3-6, the light 140 is electrically coupled to a power source 142. A switch 144 is electrically coupled to the power source 142 wherein the switch 144 is configured to activate the light 140 using the power source 142. The switch 144 is preferably configured to be a push button switch where the switch can be activated by a user's foot. In another embodiment, the switch 144 may be a toggle-type switch, a rocker switch, or other type of electromechanical switch not enumerated herein.

The power source 142 may be a battery pack, a solar cell, or any other type of small power source not enumerated herein.

In one embodiment, the light 140 and power source 142 are attached to an outer surface 122 of at least one of the plurality of vertical walls 120. In another embodiment, the light is wrapped around the plurality of vertical walls 120 and the power source 142 is attached to an outer surface of at least one of the plurality of vertical walls.

Figure 6:
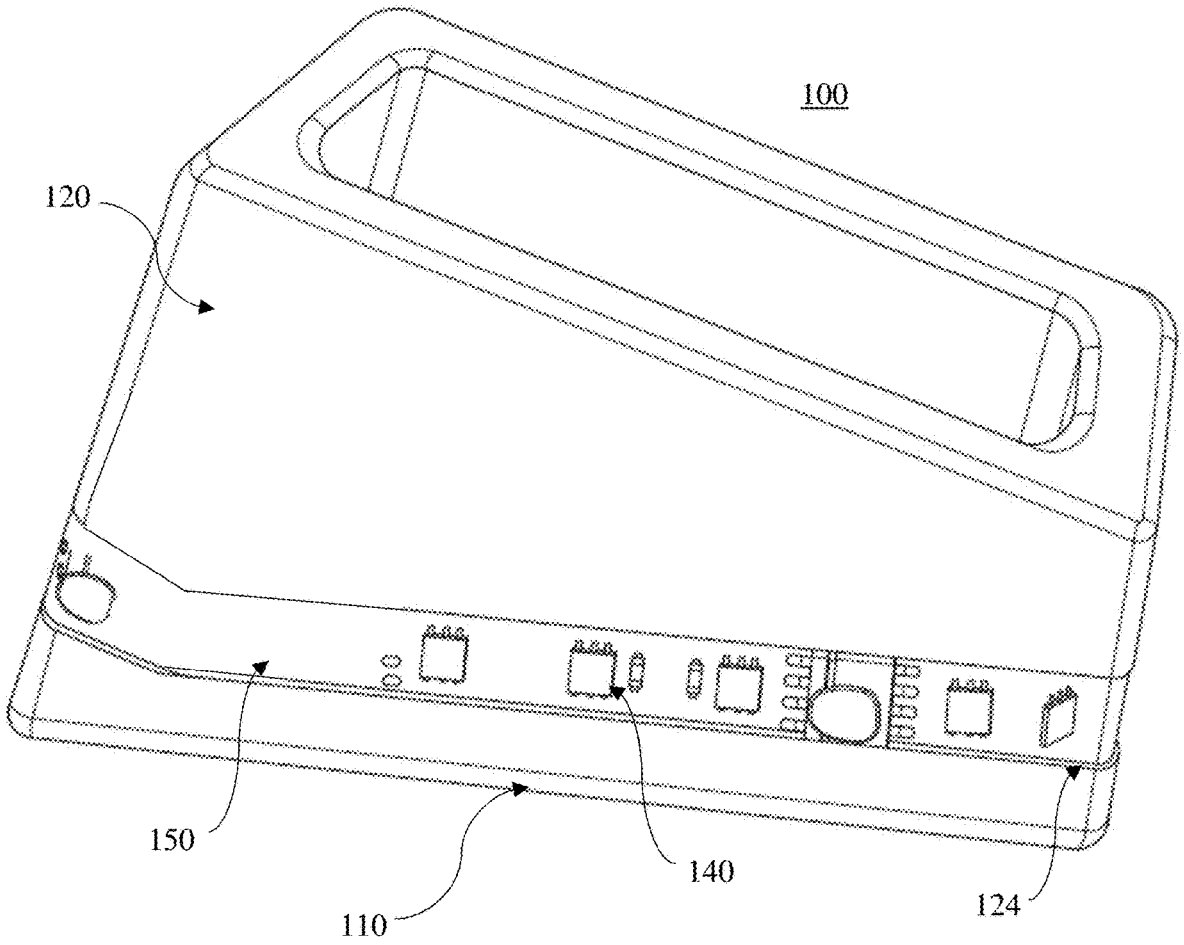
FIG. 6 shows a perspective view of a ladder foot stabilization and lighting system according to the invention.

As shown in FIG. 6, in an alternate embodiment, the light is set in a channel recess 124 within at least one of the plurality of vertical walls such that the light does not extend outward from the outer surface 122 of the plurality of vertical walls The power source is set within a recess on at least one of the plurality of vertical walls. In this embodiment, a clear or tinted cover may be placed over the light to provide protection against outside elements such as water or dirt.

Although the present invention has been described by way of example, it should be appreciated that variations and modifications may be made without departing from the scope of the invention. Furthermore, where known equivalents exist to specific features, such equivalents are incorporated as if specifically referred to in this specification.

What is claimed is:

1. A ladder stabilization and lighting system comprising:

a ladder stabilizing boot, comprising a base pad and a plurality of vertical walls extending upwardly from the base pad, wherein the plurality of vertical walls extending upward from the base pad form a rectangular recess configured to provide a friction fit on a ladder rail end; and comprising a light positioned on at least one outer surface of the plurality of vertical walls, wherein the light is powered by a power source in electrical connection with the light and a switch;

wherein the base pad is configured to be a flat planar surface larger in area than the ladder rail end; and wherein the base pad further comprises a textured bottom surface configured to prevent a ladder from moving.

2. The ladder stabilization and lighting system of claim 1, wherein the light and power source are recessed in the at least one outer surface of the plurality of vertical walls.

3. The ladder stabilization and lighting system of claim 1, wherein the light is configured to be activated by a touch button.

4. The ladder stabilization and lighting system of claim 1, wherein the ladder stabilization boot is formed as a solid one-piece unit.

5. The ladder stabilization and lighting system of claim 4, wherein the solid one-piece unit is formed of a rubber compound.

6. A ladder stabilization and lighting system comprising:

a ladder stabilizing boot comprising a base pad and a plurality of vertical walls extending upwardly from the base pad, wherein the plurality of vertical walls form a rectangular recess configured to friction fit a ladder rail end;

a light disposed on at least one outer surface of the plurality of vertical walls; and a power source configured to provide power to the light through a switch;

wherein the base pad is configured to be a flat planar surface larger in area than the ladder rail end.

7. The ladder stabilization and lighting system of claim 6, wherein the light is a LED strip light wrapping around an outer surface of the plurality of vertical walls, wherein the LED light is configured to be activated by a touch button.

8. The ladder stabilization and lighting system of claim 7, wherein the LED strip light is recessed in a horizontal channel recessed in the plurality of vertical walls.

9. The ladder stabilization and lighting system of claim 6, wherein the ladder stabilizing boot is formed as a solid one-piece unit.

10. The ladder stabilization and lighting system of claim 9, wherein the solid one-piece unit is formed of a rubber type material.

11. The ladder stabilization and lighting system of claim 6, wherein the base pad further comprises a textured bottom surface configured to prevent a ladder from moving.

12. The ladder stabilization and lighting system of claim 6, wherein the power source is a solar cell electrically coupled to the light through the switch.

13. The ladder stabilization and lighting system of claim 12, wherein the power source is electrically coupled to a battery configured to store electrical energy when the light is turned off.

* * * * *